US006162031A

United States Patent [19]

Tremoulet, Jr.

[11] Patent Number: 6,162,031

[45] Date of Patent: Dec. 19, 2000

[54] SEAL SEAT FOR HIGH PRESSURE PUMPS AND VESSELS

[75] Inventor: Olivier L. Tremoulet, Jr., Edmonds, Wash.

[73] Assignee: Flow International Corporation, Kent, Wash.

[21] Appl. No.: 09/183,748

[22] Filed: Oct. 30, 1998

[51] Int. Cl.[7] ..... F04B 39/10; F04B 53/10

[52] U.S. Cl. ..... 417/569; 417/567; 92/168; 92/165 R; 277/188

[58] Field of Search ..... 417/567, 470, 417/571, 569, 53, 403; 277/188 R; 92/168; 137/533

[56] References Cited

U.S. PATENT DOCUMENTS

| | | | |
|---|---|---|---|
| 3,905,608 | 9/1975 | Olsen et al. | 277/188 |
| 4,818,194 | 4/1989 | Saurwein | 417/567 |
| 4,960,039 | 10/1990 | Robertson | 92/165 R |
| 5,037,276 | 8/1991 | Tremoulet, Jr. | 417/568 |
| 5,050,895 | 9/1991 | Hashish et al. | 277/188 R |
| 5,102,312 | 4/1992 | Harvey | 417/571 |
| 5,111,736 | 5/1992 | Buchberger et al. | 92/168 |
| 5,380,159 | 1/1995 | Olsen, Jr. | 417/53 |
| 5,385,452 | 1/1995 | Lyday | 417/403 |
| 5,493,954 | 2/1996 | Kostohris et al. | 92/168 |
| 5,904,179 | 5/1999 | Gaillard et al. | 137/533 |
| 5,924,853 | 7/1999 | Pacht | 417/567 |

OTHER PUBLICATIONS

Manning, W. et al., "High Pressure Engineering" *Chemical And Process Engineering Series* CRC Press, International Scientific Series, pp. 269–270, 1971.

*Primary Examiner*—Teresa Walberg
*Assistant Examiner*—Leonid Fastovsky
*Attorney, Agent, or Firm*—SEED IP Law Group PLLC

[57] ABSTRACT

A seal assembly for a high pressure vessel. The pressure vessel can include a first material and can have a face with a bore extending through the face such that the bore has an edge at an intersection of the bore and the face. A check valve, including a second material, can extend into the bore and a seal seat, including a third material different than at least one of the first and second materials, can be positioned between the pressure vessel and the check valve body to reduce galling and/or fretting of the pressure vessel and check valve body.

39 Claims, 5 Drawing Sheets

SEAL SEAT FOR HIGH PRESSURE PUMPS AND VESSELS

TECHNICAL FIELD

This invention relates to seals for high pressure fluid pumps and vessels.

BACKGROUND OF THE INVENTION

Currently available high pressure fluid pumps can include plungers that reciprocate within a high pressure chamber to pressurize a fluid in the chamber, and can further include check valves to allow fluids into and out of the high pressure chamber. The pumps typically include seals between the plunger and an inner wall of the chamber and between the check valve and the inner wall of the chamber to prevent high pressure fluid from leaking out of the chamber. In such pumps, the seals must be able to operate in a high pressure environment, withstanding pressures in excess of 10,000 psi.

Currently available seal designs include seals disposed within the chamber and backup rings to support the seals. As the pressure range of high pressure fluid pumps is extended up to and beyond 100,000 psi, improved seal designs may be desirable. For example, some current seals may concentrate high loads in a portion of the high pressure chamber that is subject to wearing. The high load may cause early chamber wear, allowing fluid to leak past the seal and reduce the efficiency of the pump. Furthermore, some current seals may allow the wall of the chamber and/or the check valve to erode, which may cause early chamber wear.

SUMMARY OF THE INVENTION

The present invention is directed toward methods and apparatus for sealing the components of a high pressure vessel assembly. In one embodiment, the assembly can include a pressure vessel having a face with a bore extending through the face forming an edge at the intersection of the bore and the face. The pressure vessel can include a first material. A check valve body, including a second material, can extend into the bore. A replaceable seal seat can be positioned between the pressure vessel and the check valve body, and can include a third material that is different than at least one of the first and second materials. For example, the third material can include 410 stainless steel and the first and/or second materials can include 15-5 PH stainless steel to reduce the likelihood for galling and/or fretting between pressure vessel, check valve, and seal seat.

In one embodiment, the assembly can include a plunger that extends into the bore of the pressure vessel opposite the check valve body. The assembly can further include a second seal seat adjacent the plunger having at least one groove for supplying a lubricant to the plunger.

The present invention is also directed toward a method for coupling a pressure vessel having a first material to a check valve body having a second material. The method can include selecting a seal seat to have a third material different than the first and second materials and can further include positioning the seal seat between the check valve body and the pressure vessel, for example, to reduce the likelihood for galling and/or fretting of the pressure vessel and the check valve body.

DETAILED DESCRIPTION OF THE INVENTION

Figure 1:
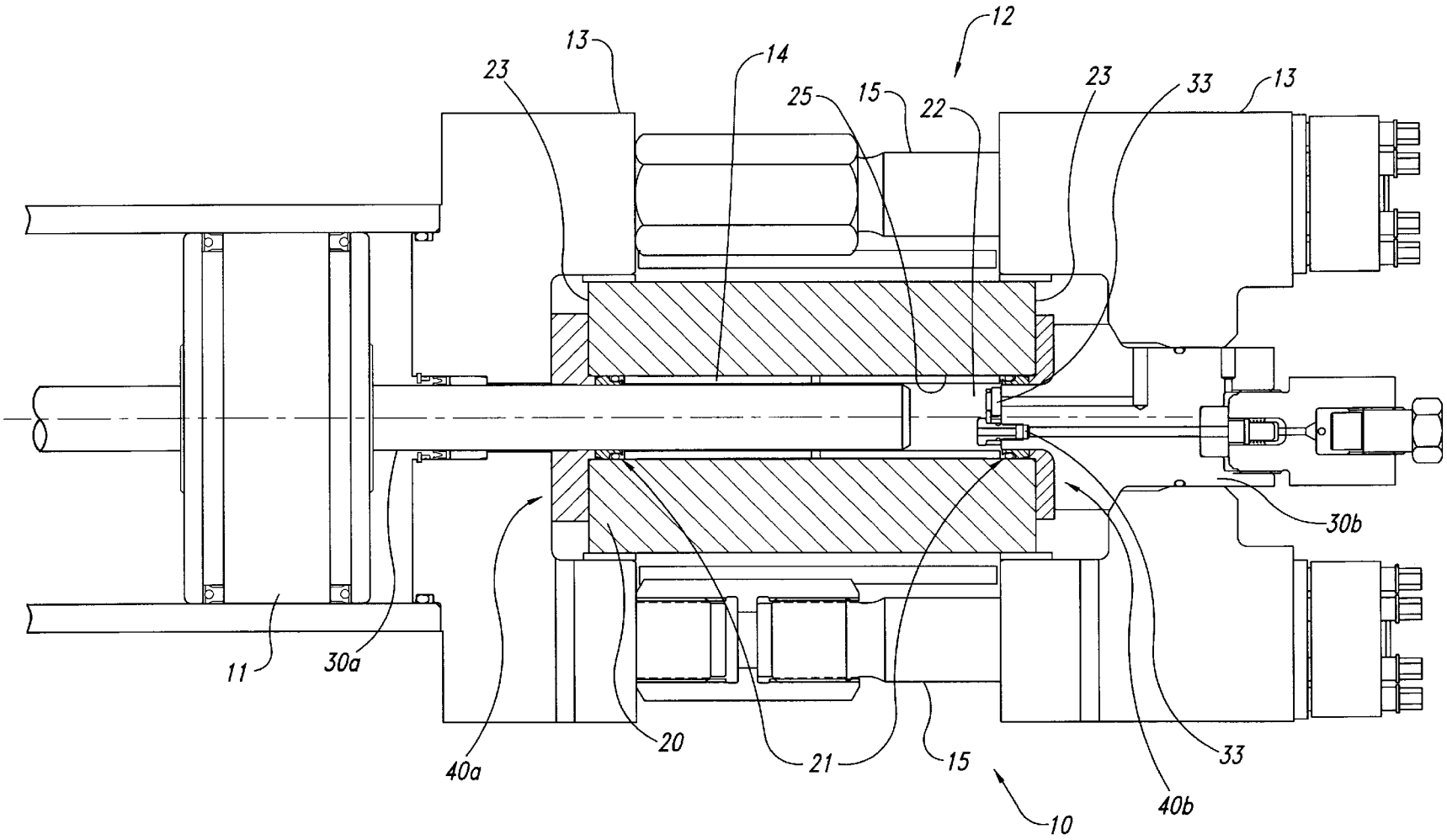
FIG. 1 is a partial cross-sectional elevation view of a high pressure pump having a seal assembly in accordance with an embodiment of the invention.

A high pressure pump 10 having seal assemblies in accordance with one embodiment of the invention is illustrated in FIG. 1. The pump 10 includes a pressure vessel 20 with opposite faces 23 and a bore 22 extending through the pressure vessel 20 between the faces 23. Two inserts 30 (shown as a plunger 30*a* and a check valve assembly 30*b*) extend into the bore 22 from opposite ends. The plunger 30*a* reciprocates within the pressure vessel 20 to pressurize a fluid in the pressure vessel. The plunger 30*a* can be driven by a hydraulically actuated piston 11 or alternatively by a mechanical actuator (not shown). The check valve assembly 30*b* has check valves 33 for admitting unpressurized fluid into the pressure vessel 20 during an intake stroke of the plunger 30*a*, and allowing pressurized fluid to exit the pressure vessel 20 after a power stroke of the plunger 30*a*. Both inserts 30 are held in position relative to the pressure vessel 20 by a yoke 12 that includes end caps 13 secured with threaded rods 15 that bias the end caps 13 toward the pressure vessel 20.

Figure 2:
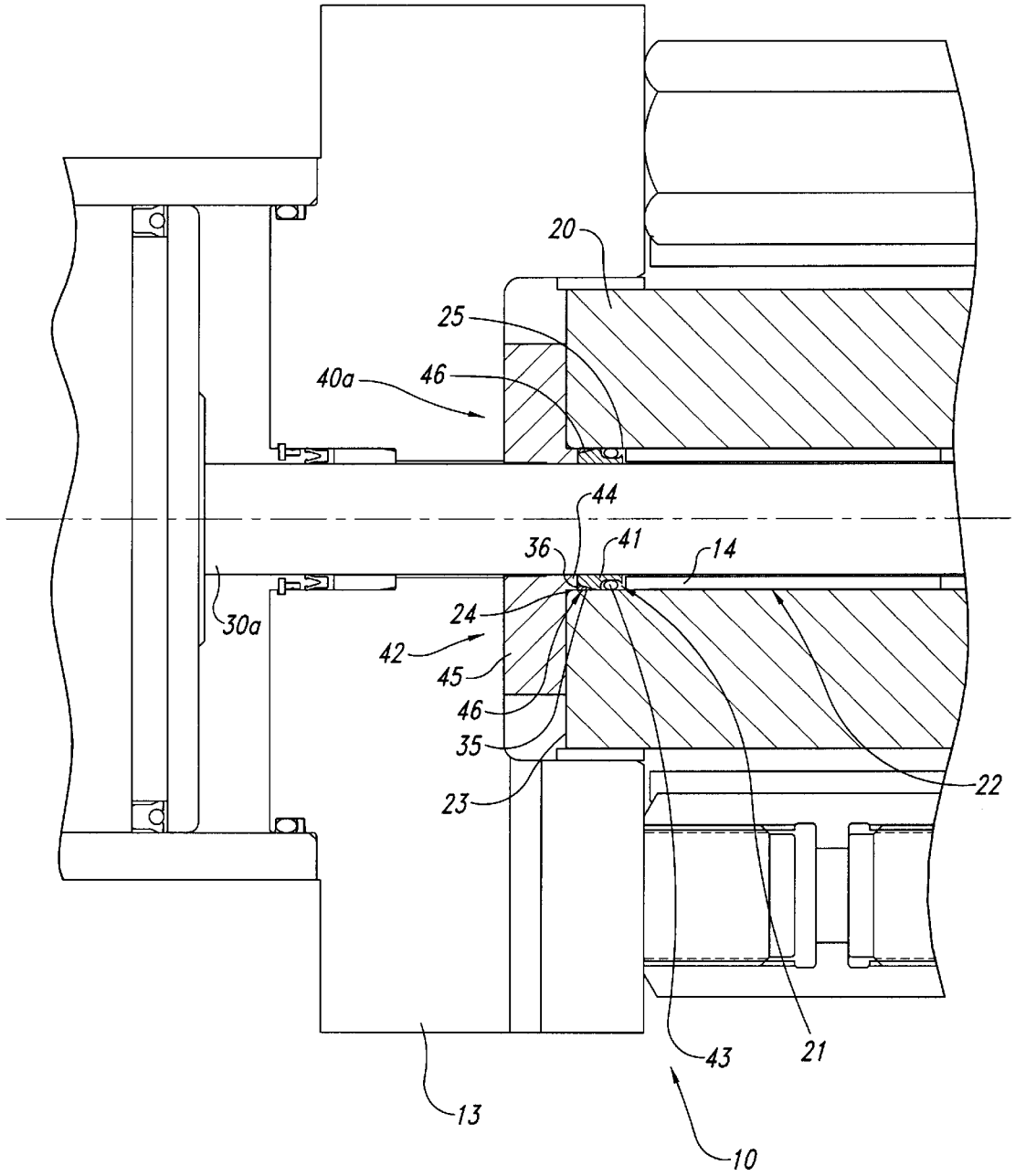
FIG. 2 is a detailed side elevation view of a portion of the pump and the seal assembly of FIG. 1.

Two seal assemblies 40 (shown as a dynamic seal assembly 40*a* and a static seal assembly 40*b*) seal a gap 21 between the inserts 30 and an inner wall 25 of the bore 22 to prevent fluid from leaking from the pressure vessel 20. The dynamic seal 40*a* seals a portion of the gap 21 between the reciprocating plunger 30*a* and the inner wall 25, and the static seal 40*b* seals a portion of the gap 21 between the stationary check valve body 30*b* and the inner wall 25. A sleeve 14 adjacent the inner wall 25 between the seal assemblies 40 reduces the volume of the gap 21. As shown in FIG. 2, the sleeve 14 can be spaced apart from both the dynamic seal 40*a* and the static seal 40*b* in one embodiment. In another embodiment, the sleeve 14 can contact either the dynamic seal 40*a* or the static seal 40*b*. In either case, the sleeve 14 does not provide for direct mechanical contact between the dynamic seal 40*a* and the static seal 40*b*.

FIG. 2 is a detailed side elevation view of a portion of the pump 10 shown in FIG. 1. For purposes of illustration, only the dynamic seal assembly 40*a* is shown in FIG. 2. However, the overall structure and operation of the dynamic seal assembly 40*a* discussed below are generally common to both the dynamic seal assembly 40*a* and the static seal assembly 40*b*.

Referring to FIG. 2, the dynamic seal assembly 40*a* can include an annular seal 41 and an O-ring 43, both positioned in the gap 21 between the plunger 30*a* and the internal wall 25 of the bore 22. The seal 41 can include a resilient material, such as an ultrahigh molecular weight polyethylene that fills the gap 21 without extruding out of the gap 21 when the pressure vessel 20 is pressurized. Accordingly, the seal 41 can be relatively stiff at low pressures. The O-ring 43 can be more flexible than the seal 41 at low pressures to seal the gap 21 when the pressure within the pressure vessel 20 is relatively low, for example, at the beginning of the power stroke of the plunger 30*a*.

The dynamic seal assembly 40*a* can further include a removable seal seat 42 between the seal 41 and the end cap 13. The seal seat 42 can include a spacer portion 44 that engages the seal 41 and spaces the seal 41 away from an edge 24 between the bore 22 and the face 23 of the pressure vessel 20. In one embodiment, an axial dimension of the spacer portion 44 is approximately equal to a radial dimension of the gap 21. In other embodiments, the spacer portion 44 can have other dimensions.

The seal seat 42 can further include a support portion 45 connected to the spacer portion 44 to support the spacer portion 44 in position and prevent the seal 41 from moving out of the gap 21 when the pressure vessel 20 is pressurized. In one embodiment, the seal seat 42 can be relatively stiff in a radial direction to resist deformation toward or away from the plunger 30*a*. In another embodiment, the seal seat 42 can be sufficiently flexible in the radial direction to allow the spacer portion 44 to flex toward the plunger 30*a* and provide an additional seal between the plunger 30*a* and the inner wall 25 as the seal seat 42 is axially compressed.

The dynamic seal assembly 40*a* can also include an anti-extrusion ring 46 disposed around the seal 41. In one embodiment, the anti-extrusion ring 46 has a generally triangular cross-sectional shape and includes an axial surface 35 and a radial surface 36. The anti-extrusion ring 46 is configured to expand radially against the inner surface 25 of the bore 22 as the pressure vessel 20 is pressurized. Accordingly, the radial surface 36 of the anti-extrusion ring can be sized to bridge a radial gap that might develop between the inner surface 25 of the expanding bore 22 and the spacer portion 44, which does not tend to expand radially as the pressure vessel 20 is pressurized. This is unlike a conventional anti-extrusion ring in which the axial surface 35 may be sized to bridge an axial gap that may develop between the support portion 45 of the seal seat 42 and the face 23 of the pressure vessel 20.

In one embodiment, the seal seat 42 can include a material that is different than the materials of the adjacent components. For example, where the seal seat 42 forms a portion of the dynamic seal assembly 40*a* and is positioned between the pressure vessel 20 and the end cap 13, the seal seat 42 can include a material different than the material of one or both of the pressure vessel 20 and the end cap 13. Where the seal seat 42 forms a portion of the static seal assembly 40*b* (FIG. 1), and is positioned between the pressure vessel 20 and the check valve body 30*b* (FIG. 1), the seal seat 42 can include a material different than the material of one or both of the pressure vessel 20 and the check valve body 30*b*. For example, the pressure vessel 20 and/or the check valve body 30*b* can include 15-5 PH stainless steel, or any suitable material having a relatively high strength, high toughness and high corrosion resistance. The corresponding seal seat 42 can include different, but generally hard, tough and corrosion resistant materials, such as 410 stainless steel, 416 stainless steel or 300 series (e.g., 302, 303, 316, etc.) austenitic stainless steel.

An advantage of an embodiment of the seal seat 42 having a material different than the material of the surrounding components is that the different materials are less likely to gall and/or fret than are similar materials placed adjacent to each other. As used herein, galling refers generally to the tendency for adjacent similar materials to bond to each other at an atomic or molecular level. Fretting, as used herein, refers generally to the tendency for such molecular or atomic bonds to break during relative motion of the adjacent components, causing portions of the components to separate and create debris, which can reduce the performance of the seal assemblies 40. Accordingly, the seal seat 42 and the surrounding components can include any combination of different materials that has a relatively low tendency to gall and/or fret when the components are positioned adjacent to each other.

As shown in FIGS. 1 and 2, the seal seat 42 is removable in one embodiment and separates the pressure vessel 20 from the end cap 13 (in the case of the dynamic seal 40*a*) and from the check valve body 30*b* (in the case of the static seal assembly 40*b*). Accordingly, if fluid leaks past the seal seat 42 and erodes the seal seat 42 and the adjacent component, it is likely that the leakage path will pass next to only one of the two adjacent components. An advantage of this arrangement is that it may be less expensive to reduce the relatively simple seal seat 42 and the one adjacent component, rather than replacing both adjacent components (e.g., both the pressure vessel 20 and the end cap 13 in the case of the dynamic seal 40*a*, or both the pressure vessel 20 and the check valve body 30*b* in the case of the static seal assembly 40*b*).

Figure 3:
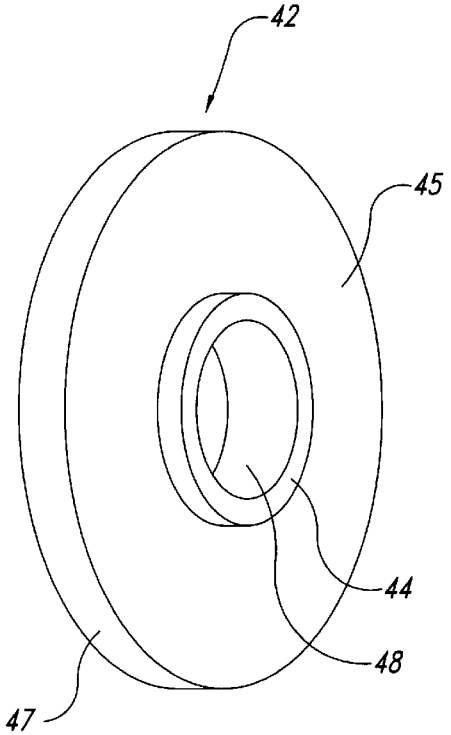
FIG. 3 is a detailed isometric view of a seal seat of the seal assembly of FIGS. 1 and 2.

FIG. 3 is an isometric view of the seal seat 42 shown in FIG. 2. The seal seat 42 has a round aperture 48 to accommodate the plunger 30*a* (FIG. 2), which has a round cross-sectional shape. The spacer portion 44 accordingly forms a circular rim around the aperture 48. In other embodiments, the seal seat 42 can have an aperture 48 and a spacer portion 44 with another shape to accommodate an insert 30 having another cross-sectional shape. In the embodiment shown in FIG. 3, the seal seat 42 also has a generally round outer edge 47 and can have differently shaped outer edges in other embodiments.

An advantage of the seal assemblies 40 shown in FIGS. 1–3, in addition to those discussed above, is that they displace or offset the seal 41 axially inward away from the edge 24 of the bore 22. This is advantageous because the seals 41 tend to exert a radial force on the inner wall 25 of the bore 22. If the seal 41 engages the inner wall 25 of the bore 22 at the edge 24, the radial force exerted by the seal may cause the diameter of the bore 22 to increase, reducing the integrity of the seal between the plunger 30*a* and the inner wall 25. Furthermore, the radial force may cause the edge 24 to wear or break, further reducing the integrity of the seal between the plunger 30*a* and the inner wall 25.

Another advantage of the seal assemblies 40 is that they displace or offset the anti-extrusion ring 46 axially inward away from the edge 24 of the bore 22. Accordingly, the edge 24 can be rounded, as shown in FIG. 2, between the inner wall 25 and the face 23 of the pressure vessel 20. Conversely, the inner wall of conventional pressure vessels may extend axially in a straight line (as seen in cross-section) all the way to the face 23 to allow the anti-extrusion ring 46 to seat properly at the end of the bore 22. The intersection of the conventional inner wall and the face 23 creates a sharp edge which may be more difficult to manufacture and handle than the rounded edge 24 shown in FIG. 2. The rounded edge 24 may also be less likely to wear or break during manufacturing, installation, and/or operation. In one embodiment, the radius of curvature of the rounded edge 24 can be in the range of approximately 0.005 inch to approximately 0.010 inch, and in other embodiments, the radius of curvature can have other values.

Figure 4:
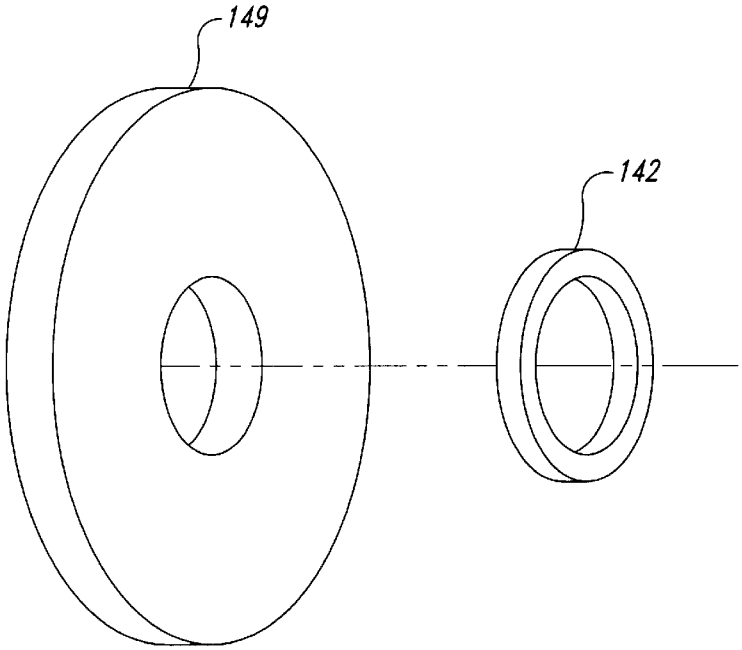
FIG. 4 is a detailed isometric view of a seal seat and a retainer in accordance with another embodiment of the invention.

FIG. 4 is an isometric view of a seal seat 142 in accordance with another embodiment of the invention. As shown in FIG. 4, the seal seat 142 corresponds generally to the spacer portion 44 of the seal seat 42 of FIG. 2. Accordingly, the seal seat 142 shown in FIG. 4 is sized to extend into the gap 21 (FIG. 2) between the insert 30 (FIG. 2) and the inner wall 25 (FIG. 2). A retainer 149, corresponding generally to the support portion 45 of the seal seat 42 shown in FIG. 2, can be positioned adjacent the seal seat 142 shown in FIG. 4 to engage the seal seat 142 and prevent the seal seat 142 from being forced out of the gap 21. An advantage of the seal seat 142 and the retainer 149 shown in FIG. 4 is that each of these components can be replaced individually should one component become worn or damaged before the other. Conversely, an advantage of the seal seat 42 shown in FIGS. 1–3 is that it may be easier to install a single seal seat 42 than both a seal seat 142 and a retainer 149.

In an alternate embodiment (not shown), the seal seat 142 shown in FIG. 4 can be affixed to the seal 41 (FIG. 2). In still further embodiments, the seal 41 and the seal seat 42 can have other configurations, so long as the seal seat 42 axially offsets the seal 41 from the edge 24. For example, the seal seat 42 can be fixed to the face 23 (FIG. 2) or other portions of the pressure vessel 20 (FIG. 2).

Figure 5:
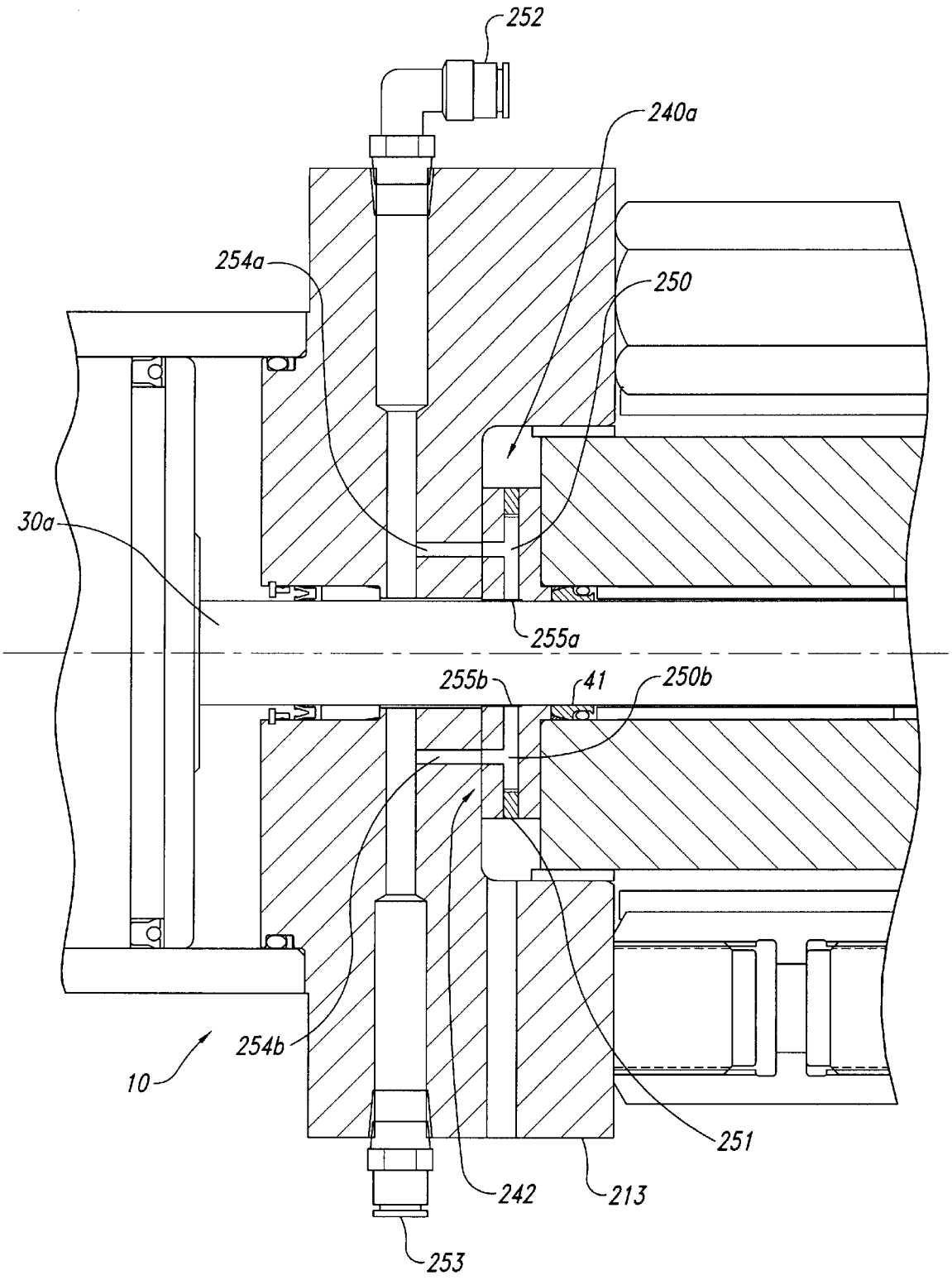
FIG. 5 is a detailed partial cross-sectional view of a pump having a seal seat with a fluid passage in accordance with still another embodiment of the invention.

FIG. 5 is a detailed side elevation view of a dynamic seal assembly 240*a* and an end cap 213 installed on the pump 10 of FIG. 1. Both the dynamic seal assembly 240*a* and the end cap 213 have fluid passages in accordance with another embodiment of the invention. The dynamic seal assembly 240*a* can include a seal seat 242 having fluid passages 250 (shown as 250*a* and 250*b*) that extend through the seal seat 242 to orifices 255 (shown as 255*a* and 255*b*) adjacent the plunger 30*a*. The fluid passages 250 can be aligned with corresponding channels 254 (shown as 254*a* and 254*b*) in the end cap 213. In one embodiment, plugs 251 can be installed in the fluid passages 250 opposite the orifices 255 to direct fluid from the fluid passages 250 to the channels 254 or vice versa. In another embodiment, the channels 250 can be blind, eliminating the need for the plugs 251.

In one embodiment, the channels 254 and the fluid passages 250 can provide an exit path for fluid that may have leaked past the seal 41. In another embodiment, the channel 254*a* of the end cap 213 can include an inlet coupling 252 connected to a source of lubricant (not shown), and the channel 254*b* can include an outlet coupling 253 connected to a lubricant receptacle (not shown). A lubricant can be pumped through the inlet coupling 252, the channel 254*a*, and the fluid passage 250*a* to lubricate an interface between the plunger 30*a* and both the seal seat 242 and the seal 41. The lubricant can exit through the fluid passage 250*b*, the channel 254*b* and the outlet coupling 253. The lubricant may be desirable where tolerances between the plunger 30*a*, the seal seat 242 and the seal 41 are very small, and/or where differences in mechanical properties of these components may cause increased friction, for example where the plunger 30*a* includes a ceramic material and the seal seat 242 includes a steel material.

Figure 6B:
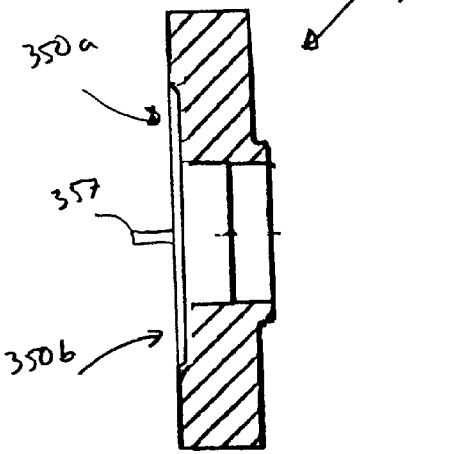
FIG. 6B is a cross-sectional view of the seal seat shown in FIG. 6A taken along line 6B—6B.
Figure 6A:
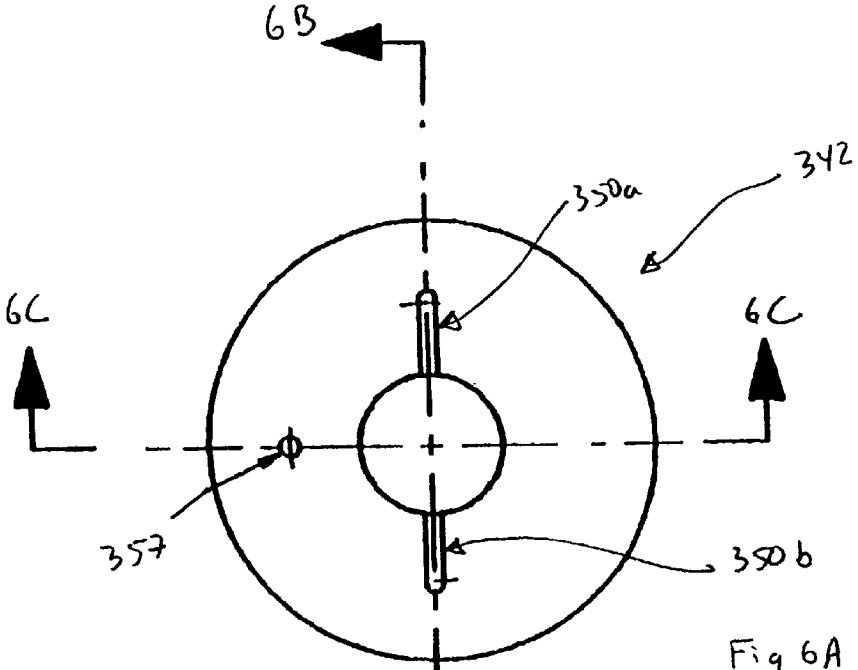
FIG. 6A is an elevation view of a seal seat in accordance with another embodiment of the invention.

FIG. 6A is an elevation view of a seal seat 342 having fluid grooves 350 (shown as 350*a* and 350*b*) in accordance with another embodiment of the invention. FIG. 6B is a cross-sectional view of the seal seat 342 shown in FIG. 6A taken along line 6B—6B. Referring to FIGS. 6A and 6B, the fluid groove 350*a* can be aligned with the channel 254*a* (FIG. 5) of the end cap 213 (FIG. 5), and the fluid groove 350*b* can be aligned with the channel 254*b* (FIG. 5), to provide a fluid path for lubricant to the plunger 30*a* (FIG. 5).

Figure 6C:
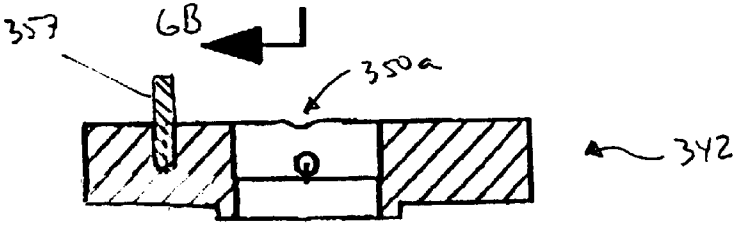
FIG. 6C is a cross-sectional view of the seal seat shown in FIG. 6A taken along line 6C—6C.

The seal seat 342 can also include an alignment pin 357, shown in FIGS. 6A and 6B and in cross-section in FIG. 6C, which aligns with a corresponding hole (not shown) in the end cap 213 to help users properly align the grooves 350. An advantage of the groove 350 shown in FIGS. 6A–6C when compared to the fluid passages 250 shown in FIG. 5 is that they may be simpler to manufacture, potentially reducing the cost of the seal seat 342.

From the foregoing it will be appreciated that, although specific embodiments of the invention have been described herein for purposes of illustration, various modifications may be made without deviating from the spirit and scope of the invention. For example, the dynamic seal assemblies described herein can be incorporated into any high pressure apparatus, including, but not limited to, a high pressure pump, to seal a gap between a stationary portion of the apparatus and a moving portion of the apparatus. Similarly, the static seal assemblies described herein can be incorporated into any high pressure apparatus, including, but not limited to, a high pressure pump, to seal a gap between two stationary portions of the apparatus. Accordingly, the invention is not limited except as by the appended claims.

What is claimed is:

1. An ultra-high pressure pump for pressurizing substances to ultrahigh pressures, comprising:

a pressure vessel having a face with a bore extending through the face, the bore having a wall with an edge at an intersection of the bore and the face, the pressure vessel including a first material;

a check valve body positioned proximate to the face of the pressure vessel, at least a portion of the check valve body extending beyond the edge of the bore into the bore, the check valve body including a second material; and a replaceable seal seat positioned between the check valve body and the face of the pressure vessel, the seal seat including a third material different than at least one of the first and second materials.

2. The pump of claim 1 wherein the first and second materials include 15-5 PH stainless steel and the third material includes 410 stainless steel.

3. The pump of claim 1 wherein the third material of the seal seat is different than both the first and second materials.

4. The pump of claim 1 wherein the portion of the check valve body extending beyond the edge of the bore into the bore forms a gap with the wall of the bore and the seal seat includes a first portion extending into the gap between the bore and the check valve body and a second portion extending out of the gap and engaging the face of the pressure vessel.

5. The pump of claim 1 wherein the portion of the check valve body extending beyond the edge of the bore into the bore forms a gap with the wall of the bore, further comprising a seal positioned in the gap between the check valve body and the wall of the bore to restrict motion of fluids through the gap.

6. The pump of claim 5, further comprising a ring positioned between the seal and the wall of the bore, the ring bridging a radial opening that extends between the wall of the bore and the seal seat when the pressure vessel expands radially under pressure.

7. The pump of claim 6 wherein the ring has a triangular cross-sectional shape and a radial dimension of the ring is at least as large as the radial opening between the wall of the bore and the seal seat.

8. The pump of claim 5 wherein the seal includes a seal member adjacent an O-ring, the O-ring having a first compressibility to deform by a selected amount at a first pressure, the seal member having a second compressibility to deform by the selected amount at a second pressure higher than the first pressure.

9. The pump of claim 1 wherein the portion of the check valve body extending beyond the edge of the bore into the bore forms a gap with the wall of the core, the check valve body has a circular cross-sectional shape and the seal seat has a circular aperture configured to receive the check valve body, the seal seat having a circular rim disposed about the aperture, the rim extending into the gap.

10. The pump of claim 9 wherein the rim extends completely around the aperture.

11. The pump of claim 9 wherein a radial dimension of the rim is approximately equal to an axial dimension of the gap.

12. The pump of claim 1, further comprising a retaining member positioned adjacent the seal seat, the retaining member having a first surface engaged with the seal seat and a second surface engaged with the face of the pressure vessel to at least restrict motion of the seal seat.

13. The pump of claim 1 wherein the edge of the bore is curved between a plane of the face of the pressure vessel and a plane of the wall of the bore, the curve having a radius in the range of approximately 0.005 inch to approximately 0.010 inch.

14. The pump of claim 1 wherein the face of the pressure vessel is a first face, the pressure vessel having a second face opposite the first face, the bore extending through the pressure vessel between the first and second faces, the edge being a first edge between the bore and the first face, the bore having a second edge at an intersection of the bore and the second face, the seal seat being a first seal seat, further comprising:

an end cap proximate to the second face of the pressure vessel, the end cap including a fourth material and having an aperture therethrough;

a plunger extending through the aperture of the end cap and into the bore adjacent the second face of the pressure vessel; and a second seal seat between the end cap and the pressure vessel, the second seal seat including a fifth material different than at least one of the first and fourth materials.

15. The pump of claim 14 wherein the seal seat has a first surface adjacent the face of the pressure vessel and a second surface adjacent the check valve body, at least one of the first and second surfaces having a groove therein for conducting fluid in at least one direction adjacent the seal seat.

16. The pump of claim 15 wherein the groove is coupled to a source of lubricant.

17. The pump of claim 1, wherein the face of the pressure vessel is a first face, the pressure vessel having a second face opposite the first face, the bore extending through the pressure vessel between the first and second faces, further comprising:

a first end cap adjacent the check valve body;

a second end cap proximate to the second face of the pressure vessel; and at least one tension member extending between the first and second end caps to bias the first and second end caps toward each other.

18. A replaceable seal seat for a high pressure pump, the pump including a pressure vessel having a face with a bore extending through the face, the bore having an edge at an intersection of the bore and the face, the pressure vessel including a first material, the pump further including a check valve body having at least one portion extending beyond the edge of the bore into the bore, the check valve body including a second material, the seal seat comprising a seal seat body being removably positioned between the check valve body and the face of the pressure vessel, the seal seat body including a third material different than at least one of the first and second materials.

19. The seal seat of claim 18 wherein the first and second materials include 15-5 PH stainless steel and the third material includes 410 stainless steel.

20. The seal seat of claim 18 wherein the third material is different than both the first and second materials.

21. The seal seat of claim 18 wherein the third material has a lower tendency to gall when in contact with the one of the first and second materials than the one of the first and second materials has with itself.

22. The seal seat of claim 18 wherein the check valve body and a wall of the bore form a gap therebetween, further wherein the seal seat body includes a first portion extending into the gap and a second portion extending out of the gap and engaging the face of the pressure vessel.

23. The seal seat of claim 18 wherein the seal seat body includes a first portion extending into a gap between the bore and the check valve body, the first portion being flexible to move toward and engage the check valve body when the pressure vessel is pressurized, the seal seat further including a second portion extending out of the gap between the bore and the check valve body.

24. The seal seat of claim 18 wherein the edge of the bore is curved between a plane of the face of the pressure vessel and a plane of the wall of the bore, the curve having a radius in the range of approximately 0.005 inch to approximately 0.010 inch.

25. A replaceable seal seat for a high pressure pump, the pump including a pressure vessel having a face with a bore extending through the face, the bore having an edge at an intersection of the bore and the face, the pump further including a check valve body having at least one portion extending beyond the edge of the bore into the bore, the seal seat comprising a seal seat body being removably positioned between the check valve body and the face of the pressure vessel, the seal seat body having a first surface adjacent the face of the pressure vessel and a second surface adjacent the check valve body, at least one of the first and second surfaces having at least one groove therein for conducting fluid in at least one direction adjacent the seal seat.

26. The seal seat of claim 25 wherein the groove is coupled to a source of lubricant.

27. The seal seat of claim 25 wherein the pressure vessel includes a first material, the check valve body includes a second material, and the seal seat body includes a third material different than at least one of the first and second materials.

28. The seal seat of claim 27 wherein the first and second materials include 15-5 PH stainless steel and the third material includes 410 stainless steel.

29. The seal seat of claim 27 wherein the third material has a lower tendency to gall when in contact with the one of the first and second materials than the one of the first and second materials has with itself.

30. A method for coupling a check valve body to a pressure vessel of a high pressure pump, the check valve body including a first material, the pressure vessel including a second material, the method comprising:

selecting a seal seat to have a third material different than at least one of the first and second materials; and positioning the seal seat between the check valve body and the pressure vessel.

31. The method of claim 30 wherein at least one of the first and second materials includes 15-5 PH stainless steel and selecting the seal seat includes selecting the third material to include 410 stainless steel.

32. The method of claim 30 wherein a portion of the check valve body extends into a bore of the pressure vessel and forms a gap with a wall of the bore, further comprising positioning a seal in the gap and engaging the seal with the seal seat to restrict motion of fluids through the gap.

33. The method of claim 32, further comprising bridging a radial opening between the seal seat and the wall of the bore with a ring extending around the seal adjacent the seal seat.

34. The method of claim 30, further comprising flexing a portion of the seal seat toward the check valve to seal the seal seat against the check valve.

35. A method for coupling a check valve body to a pressure vessel of a high pressure pump, the check valve body including a first material, the pressure vessel including a second material, the method comprising reducing at least one of galling and fretting between the check valve body and the pressure vessel by selecting a seal seat to have a third material different than at least one of the first and second materials and positioning the seal seat between the check valve body and the pressure vessel.

36. The method of claim 35 wherein at least one of the first and second materials includes 15-5 PH stainless steel and selecting the seal seat includes selecting the third material to include 410 stainless steel.

37. The method of claim 35 wherein a portion of the check valve body extends into a bore of the pressure vessel and forms a gap with a wall of the bore, further comprising positioning a seal in the gap and engaging the seal with the seal seat to restrict motion of fluids through the gap.

38. The method of claim 37, further comprising bridging a radial opening between the seal seat and the wall of the bore with a ring extending around the seal adjacent the seal seat.

39. The method of claim 35, further comprising flexing a portion of the seal seat toward the check valve to seal the seal seat against the check valve.

* * * * *

UNITED STATES PATENT AND TRADEMARK OFFICE

CERTIFICATE OF CORRECTION

PATENT NO : 6,162,031
DATED : December 19, 2000
INVENTOR(S) : Olivier L. Tremoulet, Jr.

It is certified that errors appear in the above-identified patent and that said Letters Patent are hereby corrected as shown below:

Claim 9, column 7, line 11 "wall of the core," should read --wall of the bore--.

Signed and Sealed this

Eighth Day of May, 2001

*Attest:*

Nicholas P. Godici

NICHOLAS P. GODICI

*Attesting Officer*

*Acting Director of the United States Patent and Trademark Office*